US006916103B2

(12) United States Patent
Currie et al.

(10) Patent No.: US 6,916,103 B2
(45) Date of Patent: Jul. 12, 2005

(54) ILLUMINATED GUARD RAIL

(75) Inventors: Robert M. Currie, Longbeach, MS (US); Jonas J. Robertson, Harvey, LA (US)

(73) Assignee: Plastic Inventions and Patents, Inc., St. Laurent (CA)

( * ) Notice: Subject to any disclaimer, the term of this patent is extended or adjusted under 35 U.S.C. 154(b) by 0 days.

(21) Appl. No.: 10/385,439

(22) Filed: Mar. 12, 2003

(65) Prior Publication Data

US 2004/0022054 A1 Feb. 5, 2004

Related U.S. Application Data

(60) Provisional application No. 60/363,607, filed on Mar. 12, 2002.

(51) Int. Cl.[7] ..... F21V 33/00

(52) U.S. Cl. ..... 362/145; 362/152; 362/555

(58) Field of Search ..... 362/26, 145, 146, 362/152, 249, 250, 555, 559, 560, 576, 800; 256/13.1; 404/14

(56) References Cited

U.S. PATENT DOCUMENTS

| | | | | |
|---|---|---|---|---|
| 5,641,241 A | * | 6/1997 | Rushing | 362/152 |
| 6,065,852 A | * | 5/2000 | Crumley | 362/146 |
| 6,425,676 B1 | * | 7/2002 | Lyons | 362/152 |
| 6,550,952 B1 | * | 4/2003 | Hulse et al. | 362/555 |

* cited by examiner

*Primary Examiner*—Y. My Quach-Lee
(74) *Attorney, Agent, or Firm*—Merek, Blackmon & Voorhees, LLC

(57) ABSTRACT

The present invention relates to a method of illuminating bridge and road guard rails. The outside of the rails are coated with a reflective material and then co-extruded with an acrylic material surrounding the rail. Alternatively, two or more acrylic materials or tubes are extruded around a rail. The inner tube preferably has a colored shiny or reflective covering, or stripes of one or more colors, or with a picture or design on the outside or within the tube. In a further embodiment, the rails can be retrofitted with a two-section acrylic covering that fits together along and surrounds the length of the rail. The acrylic coverings can also be joined via a collar that is also made in two halves to fit around the rail at each rail post or at each end of the rail section.

19 Claims, 9 Drawing Sheets

ILLUMINATED GUARD RAIL

This application claims the benefit of U.S. Provisional Application No. 60/363,607 filed on Mar. 12, 2002.

BACKGROUND OF THE INVENTION

A. Field of the Invention

The present invention relates to generally to illuminating bridge guard rails. More specifically, the invention relates to retrofitting guard rails for illumination purposes.

B. Description of the Prior Art

Guard rails on highway roads and bridges are designed to protect motorists from driving off the roadway into on-coming traffic of off the bridge. Although these guard rails save numerous lives every year, there are instances when the guard rails that are designed to save lives actually cause harm and sometimes even death to the motorists they were designed to protect. This happens usually during nighttime driving when because of the lack of illumination on some guard rails, the motorists are incapable of seeing the guard rails and sometimes drive into them. Presently bridge guard rails do not incorporate a method for covering the guard rails with an illuminated covering or clad. It is, therefore, the object of this present invention to describe a way to illuminate these guard rails using state of the art technology in a way that will enhance driver safety when on the roadways.

SUMMARY OF THE INVENTION

The present invention is accomplished by incorporation a method of illuminating bridge and other guard rails. The rails (usually circular or rectangular in cross-section), can either be manufactured wherein special light-reflective materials are placed on the rail with an acrylic covering placed or extruded over the rail. In the alternative, existing guard rails could be retrofitted with an acrylic covering that will reflect or illuminate light.

Accordingly, it is a principal object of the invention to illustrate methods of illuminating bridge and road guard rails.

It is another object of the invention to illuminate bridge guard rails using an extrusion process wherein the rail is coated with a light-reflective material and the acrylic covering is extruded over the coated rail.

It is a further object of the invention to illuminate bridge and guard rails using a retrofit conversion package wherein a light-reflective acrylic covering is placed over the rails.

Still another object of the invention is to illuminate the bridge and guard rails using light emitting diodes (LEDs).

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings. The present invention.

DETAILED DESCRIPTION OF THE PREFERRED EMBODIMENTS

The present invention relates to a method of illuminating bridge and road guard rails. In a first embodiment, the outside of the rails are coated with a reflective material and then co-extruded with an acrylic material with the acrylic material surrounding the rail. In a second embodiment, instead of one acrylic material, two or more acrylic materials are extruded wherein the rail is in the center, an inner acrylic tube surrounds the rail and an outer acrylic tube surrounds both the rail and the inner acrylic tube. The inner tube could have a colored shiny or reflective covering, or stripes, of one or more colors, or a picture or design on the outside or within the tube. The outer acrylic tube would fit snugly over the first or inner acrylic tube. Multiple tubes could be used with different parts of a picture or design on each succeeding tube, creating the effect of depth or three dimensions to the illuminated design.

In a third embodiment, the bridge or road guard rails can be retrofitted with the acrylic coverings. The acrylic coverings are manufactured in two longitudinal half pieces that fit together along the length of the rail section. The two acrylic coverings can be joined together using screws, bolts or snap fittings or similar connection devices known to those in the art. Alternatively, the two acrylic coverings can be joined via a collar that is also made in two halves. The collars fit around the rail and are located against the rail post at each end of the rail section.

A unique and decorative acrylic tube can be created by wetting the inner surface of an acrylic tube with Acetone or any other solvent containing Methyl Ethyl Keystone or similar solvent. The interaction between this chemical and the chemicals in the acrylic rod cause the acrylic rod to crack from the inside toward the outside in a myriad of small, random shaped and sized cracks. Limiting the duration of this chemical reaction results in many cracks per linear inch of the acrylic rod that do not extend to the outer surface of the acrylic. An acrylic rod so treated illuminates in a beautifully unique way simulating what one would expect to see if a hollow ice cycle could be illuminated.

Figure 1:
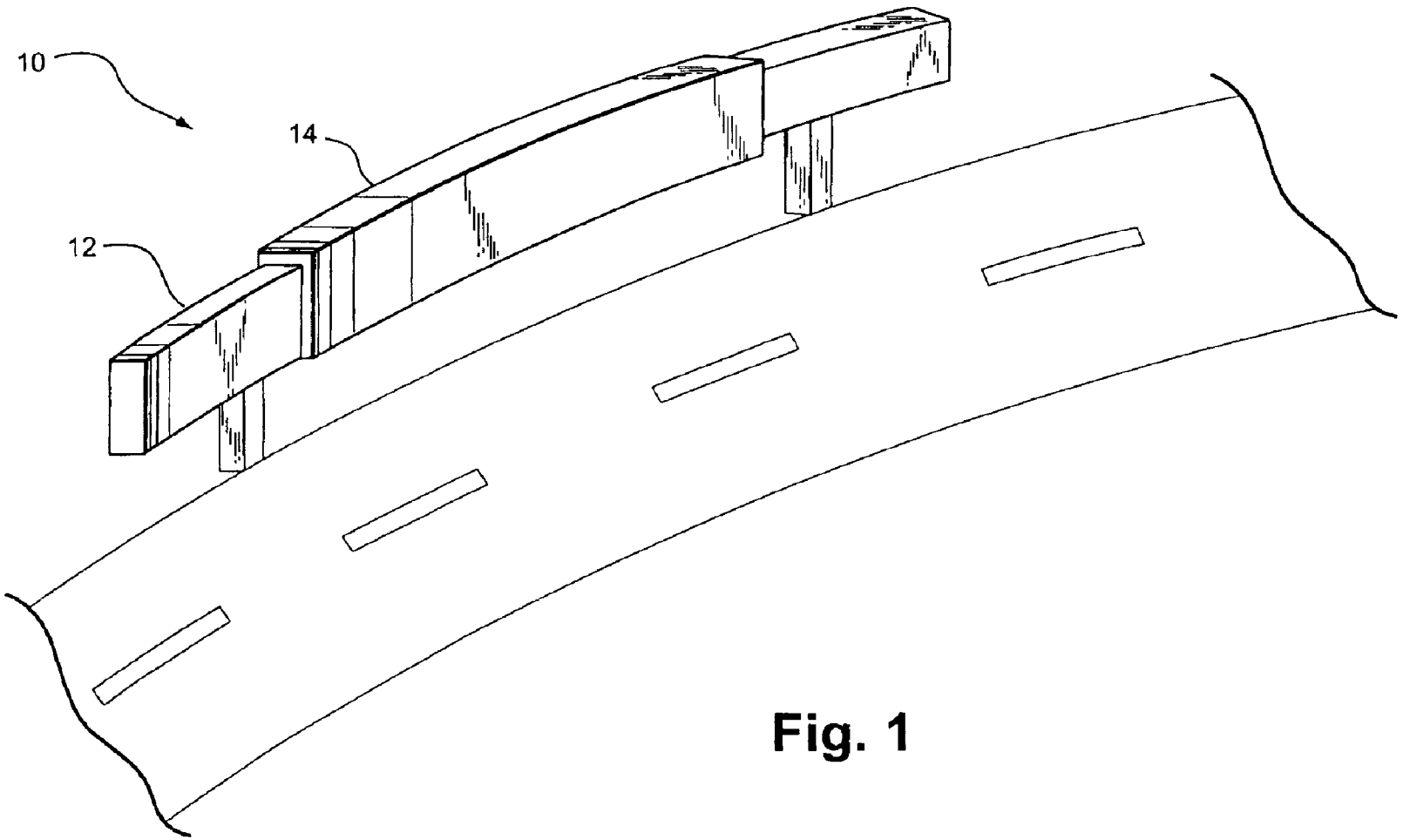
FIG. 1 is an environmental view of the guard rail with an acrylic covering.

Turning now to FIG. 1 of the drawings, bridge or road guard rail 10 is shown wherein the acrylic covering 14 covers the rail 12. The acrylic covering 14 brilliantly illuminates the bridge or road guard rail 10 when a light source is illuminated therein.

Figure 2:
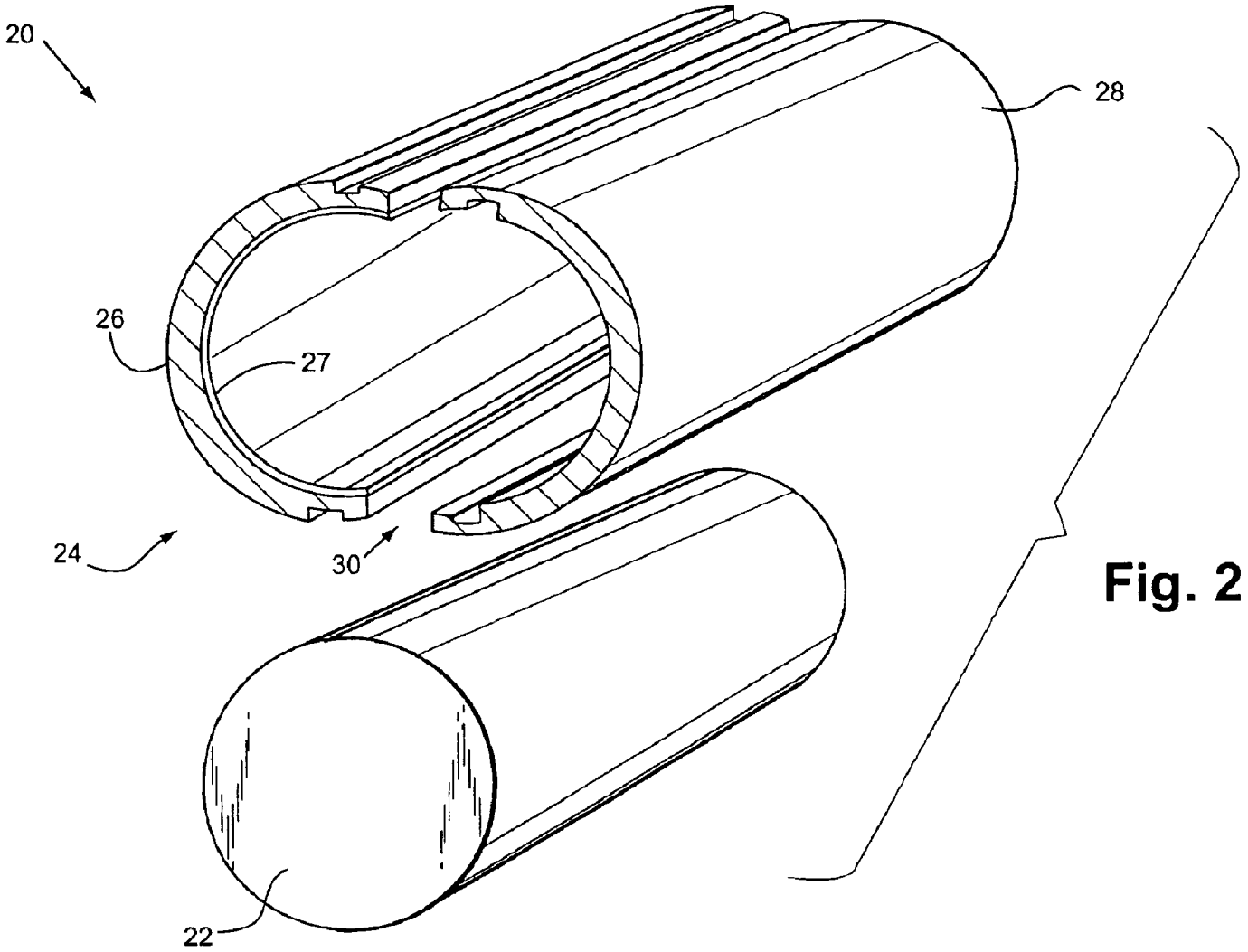
FIG. 2 is a perspective view of a method of retrofitting a rail section using a snap fitting.

There are various ways to cover the rail with illuminating materials. One such method is illustrated in FIG. 2. A retrofit guard rail 20 is shown wherein an existing rail 22 is enclosed within an acrylic covering 24. The acrylic covering 24 is manufactured in two pieces 26, 28 and brought together to cover rail 22. Snap fittings 30 ("fastener") are designed to securely hold the two separate pieces 26, 28 together over the rail 22. A reflective material 27 runs along the inside of the two separate pieces 26, 28 and extends the length of the two pieces 26, 28. The reflective material 27 is usually made of a white acrylic paint or any combination of material and color that reflects light. When a light source is directed at one of the ends of the retrofit guard rail 20, (to shine longitudinally down or along the acrylic covering 24), the retrofit guard rail 20 will illuminate in a very bright color. For instance, if a red light source is directed longitudinally down or along the acrylic covering 24 then the retrofit guard rail 20 will illuminate in the color red.

Figure 3:
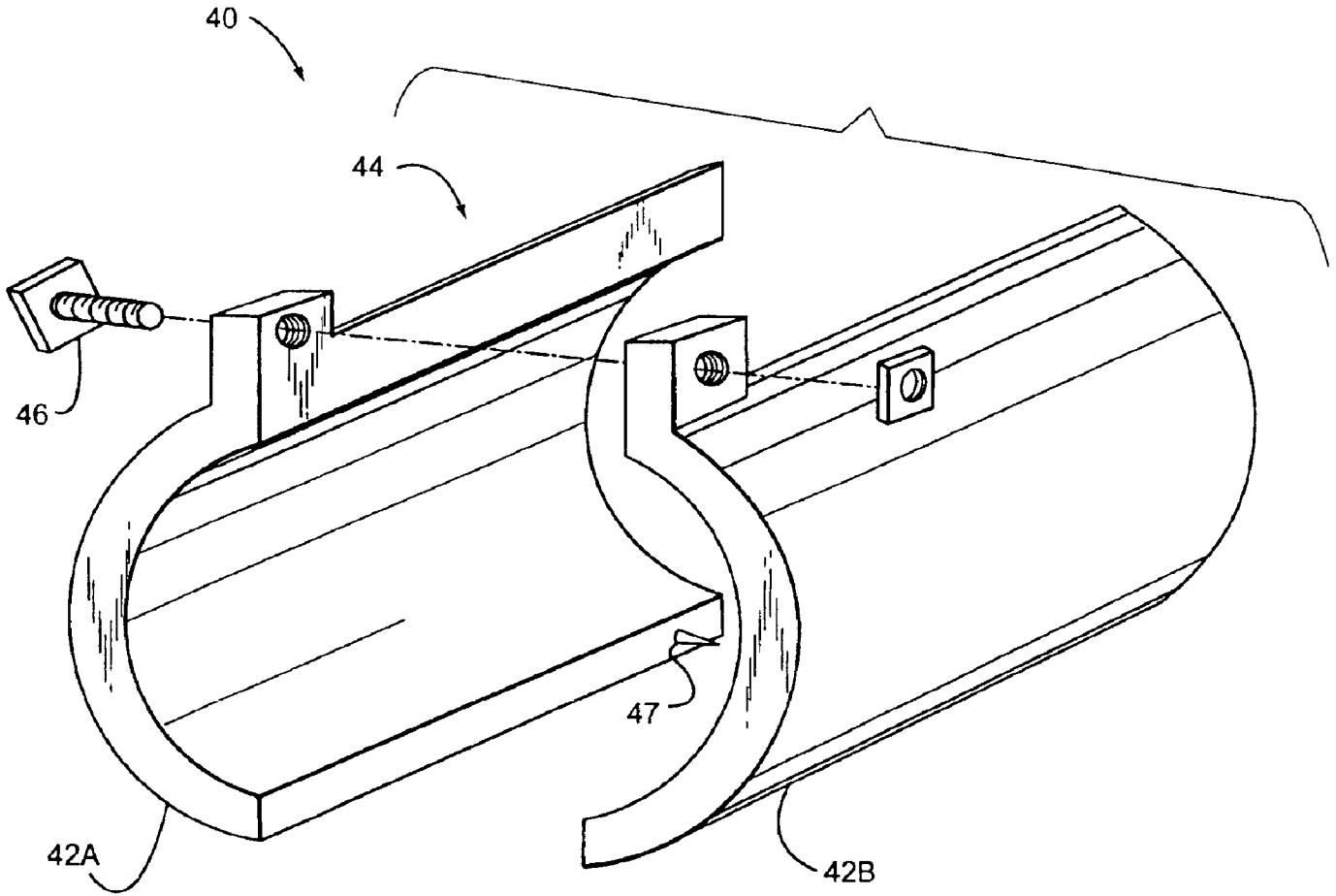
FIG. 3 is a perspective view of a method of retrofitting a rail section using screws.
Figure 4:
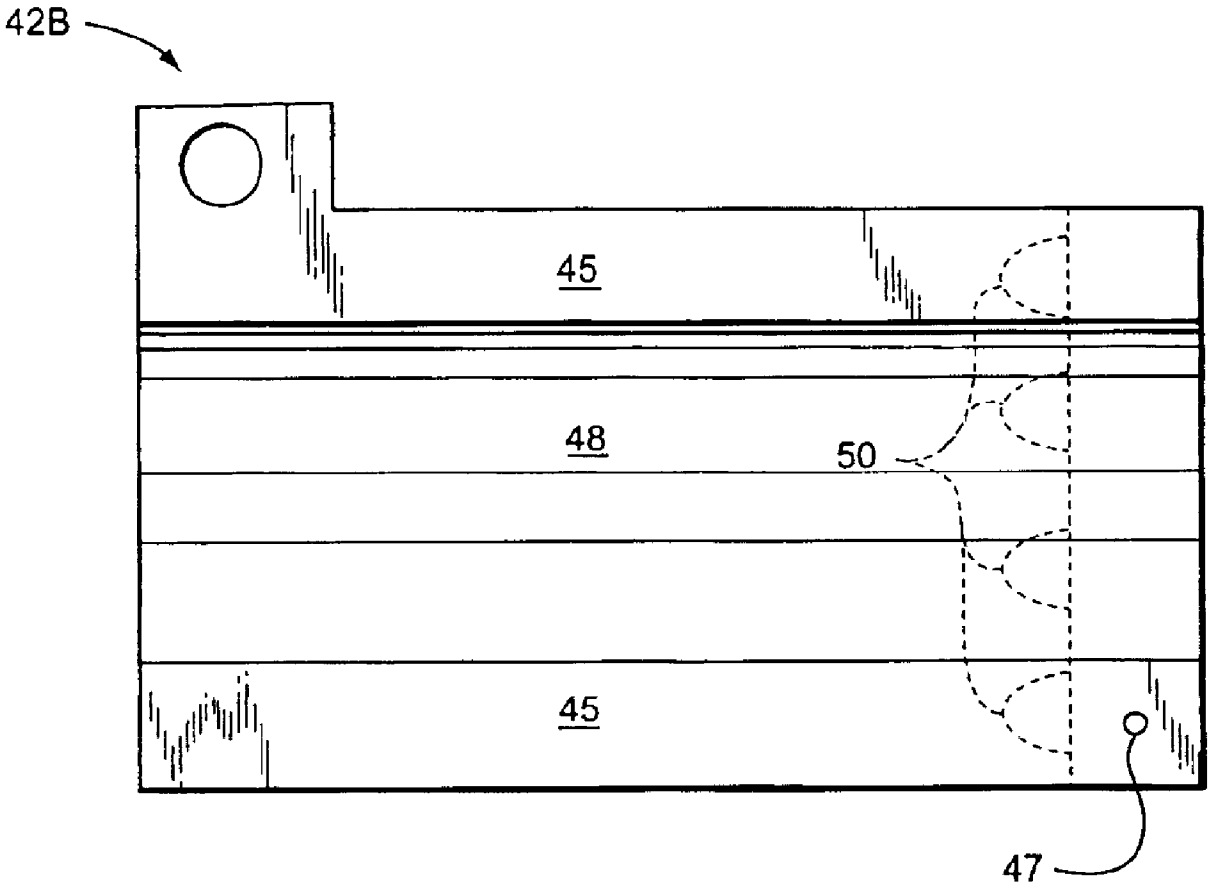
FIG. 4 is a right side view of a method of retrofitting a rail section showng LEDs.

FIGS. 3 & 4 illustrate a retrofit guard rail 40 using an alternative method of joining two pieces of acrylic coverings 42A, 42B. The two adjoining pieces of acrylic coverings 42A, 428 are secured via a raised section (seen generally at 44) wherein a screw 46 is disposed therein. An inner wall 48 of the covering is sized to fit about the guard rail. The Light Emitting Diodes (LEDs) 50, are designed to illuminate the acrylic material 45. A locating pin 47 may be used to ensure that the two halves of the covering are properly aligned about each other.

Figure 5:
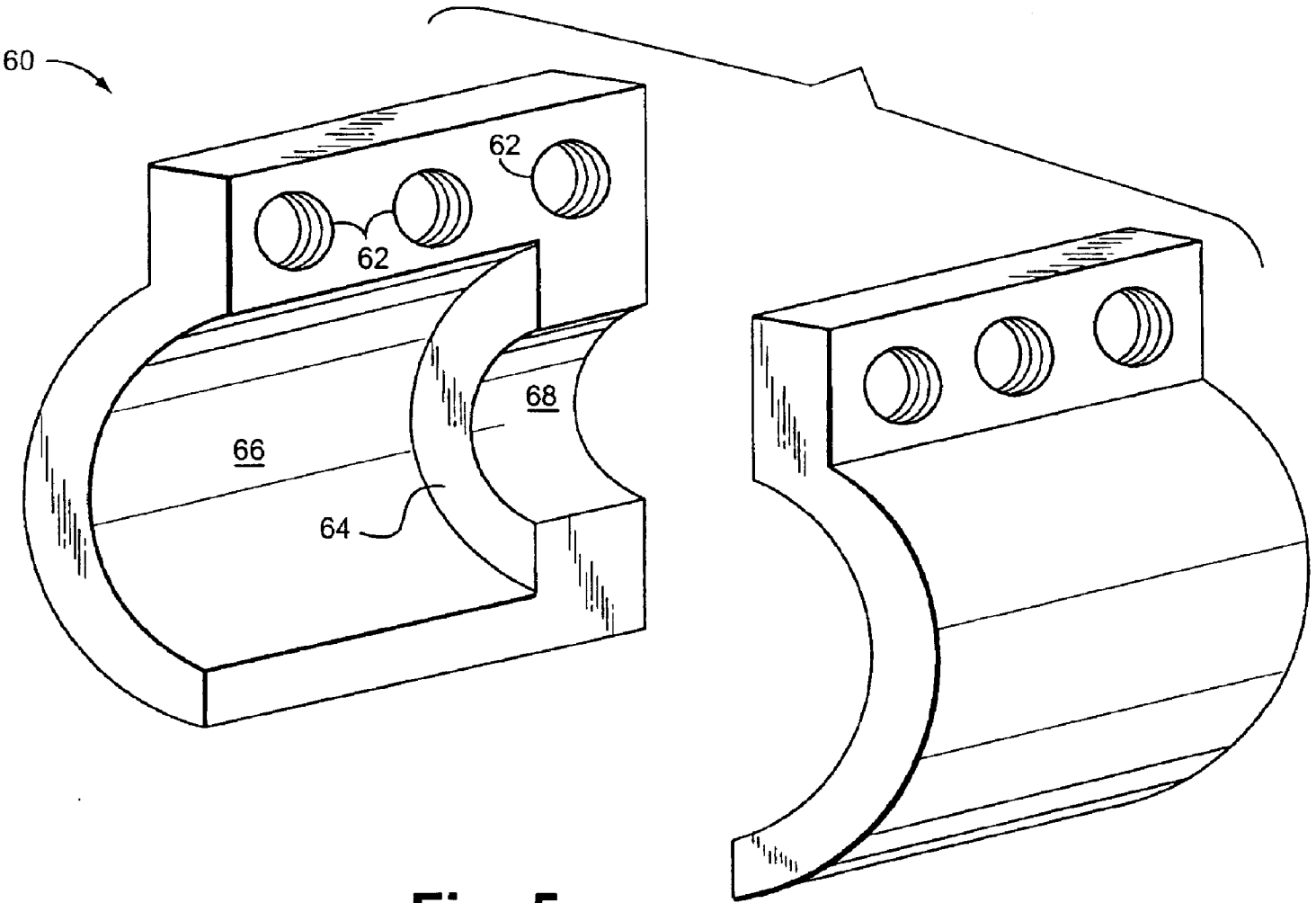
FIG. 5 is a perspective view of a connector collar.
Figure 6:
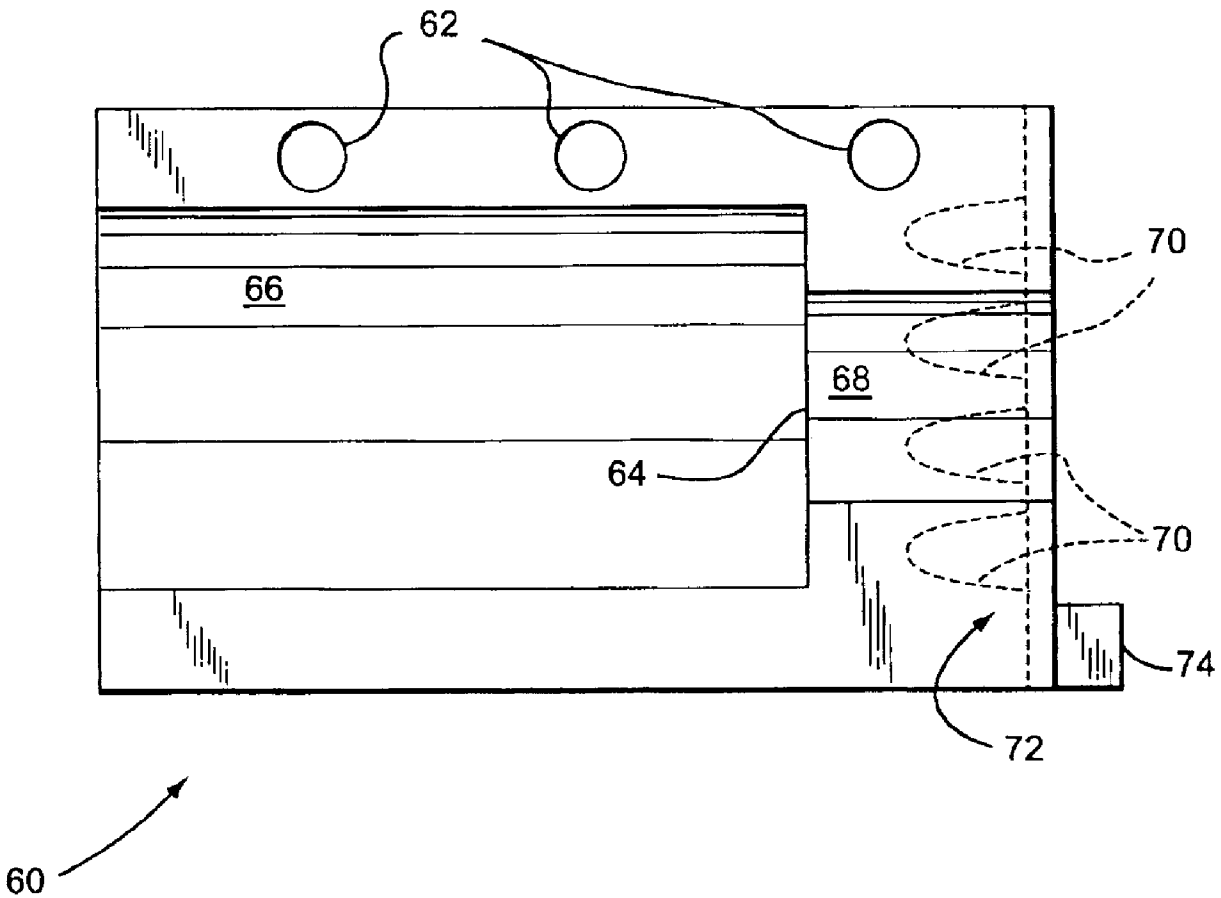
FIG. 6 is a side view of a connector collar showing LEDs.

FIGS. 5 & 6 illustrate yet another method of securing two separate pieces of acrylic coverings by using an end cap 60 ("collar"). The end cap or collar 60 is made of acrylic and has two holes 62 dimensioned and configured to receive screws to secure the two end caps 60 together. The end caps 60 are dimensioned and configured to receive a retrofitted rail wherein the rail part fits within section 68 and the rail with an acrylic covering fits within section 66. The acrylic covering of the retrofitted rail abuts against stop 64. LEDs 70 illuminate the acrylic covering of the retrofitted rail and are connected to control box 74 via wires 72. A control box 74 can preferably control the frequency and intensity of illumination of the LEDs 70 by means of a rheostat, or solid-state dimmer. Different colored LEDs that illuminate the acrylic covering could be illuminated steadily, in different sequences, in groups, or modulated in intensity by a sound sensitive power supply (not shown) or by musical tunes programmed within control box 74. The control box 74 and LEDs 70 derive their power from a power source (not shown) and preferably the control box 74 can itself be controlled remotely. Control box 74 can include means for automatically powering on various LEDs 70 of different colors at the same or different times.

Figure 7:
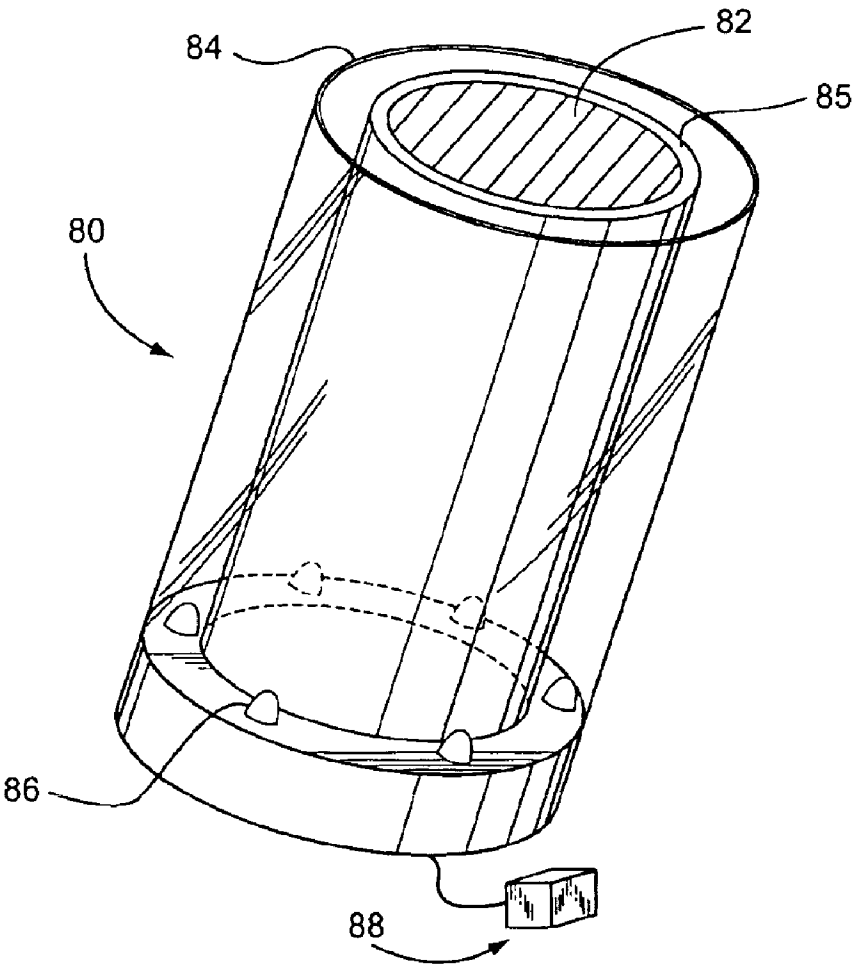
FIG. 7 is a perspective view of an extruded rail and acrylic covering showing LEDs.

FIG. 7 shows a bridge or road guard rail 80 that has been manufactured using the extrusion process. The rail 82 is first coated with a light reflective material 85 and then extruded within an acrylic covering 84. This light reflective material is usually made of a white acrylic paint although any combination of color and material that will reflect light is acceptable. Located at one end of the guard rail 80 are a plurality of LEDs 86. These LEDs 86 provide illumination which illuminates in a longitudinal direction or lengthwise direction down the length of guard rail 80. The material property of the acrylic serves as an excellent conductor of light such that (with the light reflective material 85) when illuminated by the LEDs 86, the acrylic covering 84 illuminates in the same color as the LEDs 86. A control box 88 can control the frequency and intensity of illumination of the LEDs 86 by means of a rheostat, or solid-state dimmer. Different colored LEDs that illuminate the acrylic covering could be illuminated steadily, in different sequences, in groups, or modulated in intensity by a sound sensitive power supply (not shown). The control box 88 and LEDs 86 derive their power from a power source (not shown) and the control box 88 can itself be controlled remotely. Control box 88 can include means for automatically powering various colored LEDs 86 at the same or different times.

Figure 8:
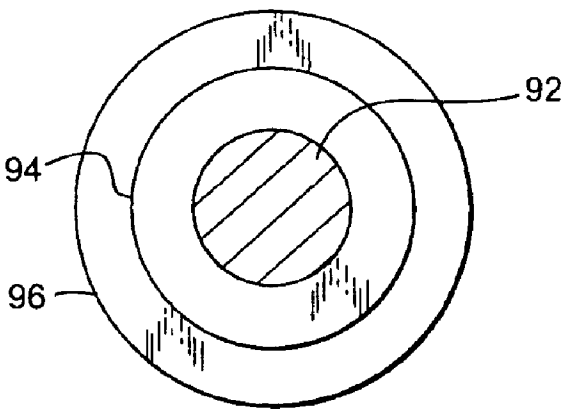
FIG. 8 is a cross-sectional view showing the rail surrounded by an inner tube and an outer tube.
Figure 9:
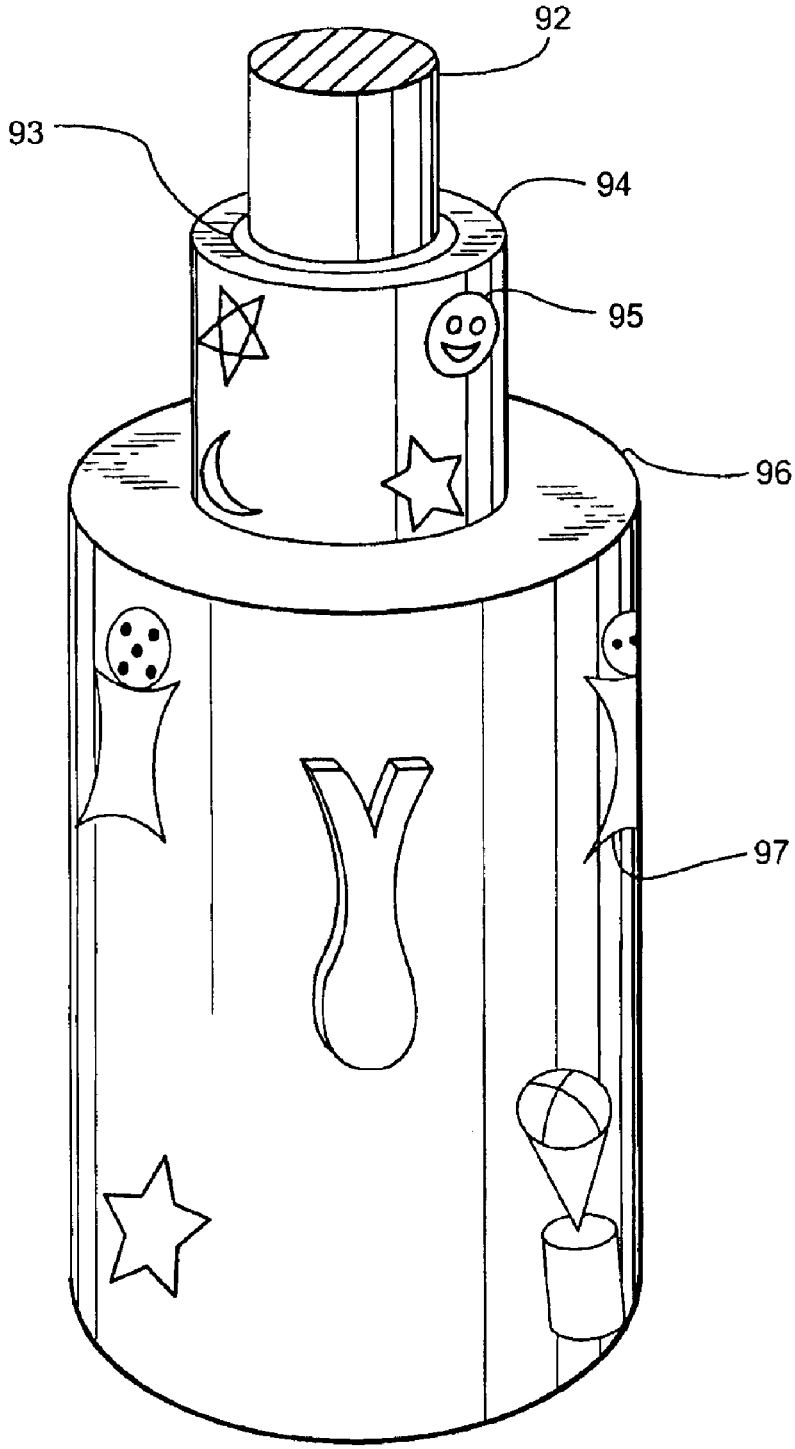
FIG. 9 is a perspective view showing the inner and outer tubes having designs thereupon.

FIGS. 8 and 9 disclose a co-extrusion method wherein an inner acrylic tube 94 is extruded with an outer acrylic tube 96 over a rail 92. Inner tube 94 could have a colored shiny or reflective covering 93, or stripes of one or more colors or a picture or design 95 on the outside of the inner tube 94 or a picture or design within the inner tube 94. The second or outer acrylic tube 96 fits snugly over the inner tube 94. Although only two tubes are shown here, multiple tubes could be used with different parts of a picture or design 95 & 97 on each succeeding tube, creating the effect of depth or three dimensions to the illuminated design. If the different tubes are of adequate thickness, then individual LEDs could be directed to illuminate individual tubes resulting in different layers of the pictures being illuminated with different colored light. As with all the other embodiments, a plurality of LEDs with a power source and control unit are used to illuminate the inner tube 94 and the outer tube 96.

Figure 10:
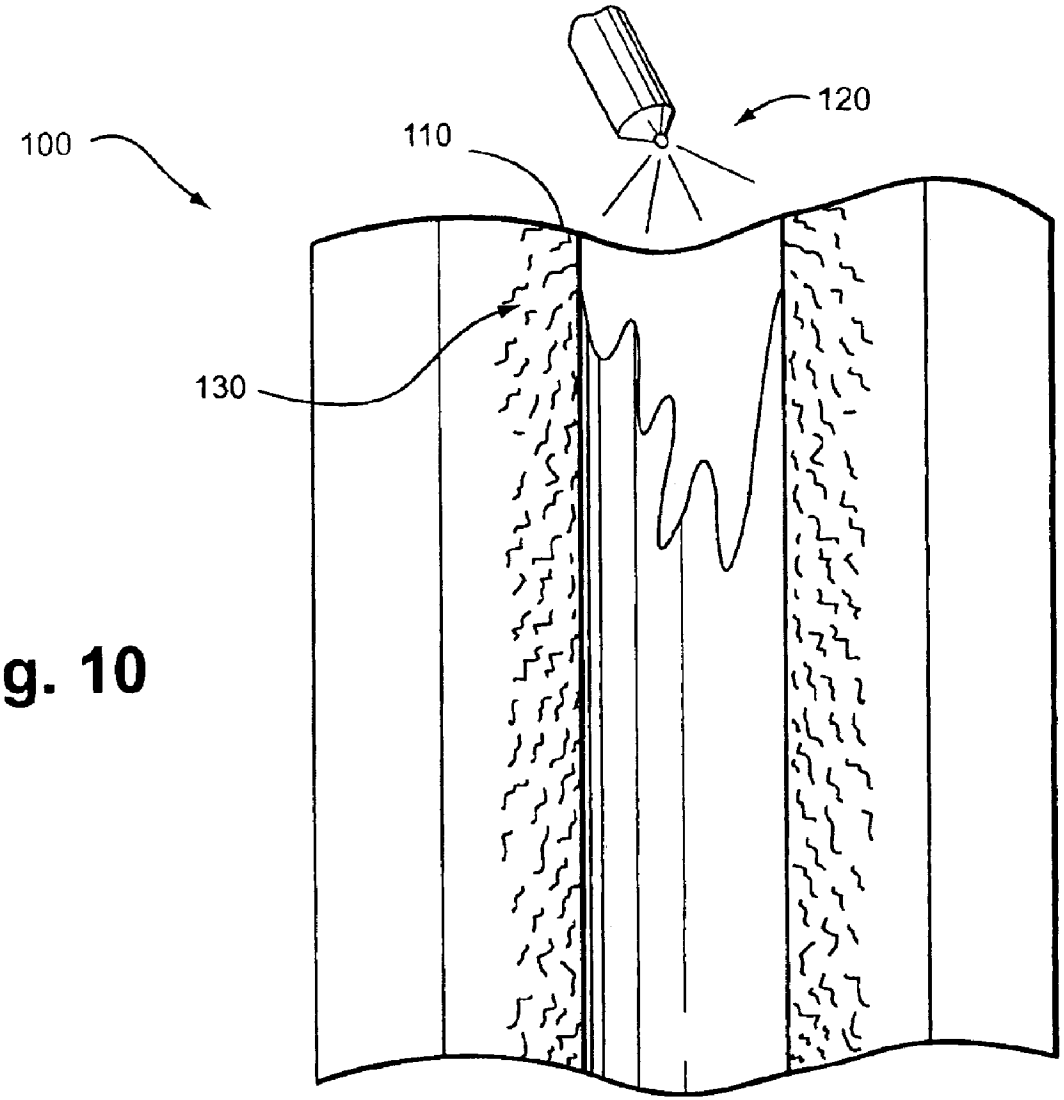
FIG. 10 is a side view showing a solvent being applied to the inner tube to cause small cracks to form on the inner surface of the inner tube.

As seen in FIG. 10, a unique and decorative acrylic tube 100 can be created by wetting the inner surface 110 of an acrylic tube with Acetonel 20, any other solvent containing Methyl Ethyl Keytone, or any other similar solvent. The interaction between this chemical and the chemicals in the acrylic rod cause the acrylic rod to crack 130 from the inside toward the outside in a myriad of small, random shaped and sized cracks 130. Limiting the time of this chemical reaction results in many cracks per linear inch of the acrylic rod that does not extend to the outer surface of the acrylic. An acrylic rod so treated illuminates in a beautifully unique manner similar to what one would expect to see if a hollow ice cycle could be illuminated.

In all of the embodiments disclosed above, the acrylic covers can be extruded with a special type of material called LISA Plastic. "LISA" is an abbreviation for the Germen word "lichtsammeln" which means "light collecting". When a material is made with LISA Plastic, the material will illuminate in a bright, beautiful color based on the color of the LED. While with LISA Plastic, there is no need for a reflective backing or coating on the rail or inner acrylic tubing, a white fluorescent reflecting coating is preferably used to enhance the lighting effects.

It is to be understood that the present invention is not limited to the sole embodiments described above, but encompasses any and all embodiments within the scope of the following claims. One skilled in the art would recognize that the term "guard rail" is not limited to a roadside rail, but could be any railing indoors or outdoors, but prefers refers to a rail that guards or guides objects or persons nearby.

We claim:

1. An illuminated guard rail comprising;

a conventional guard rail, a light reflective cover wherein said light reflective cover is dimensioned and configured to cover said conventional guard rail, means for surrounding said conventional guard rail with said light reflective cover, illumination means for illuminating said light reflective cover, control means for controlling various functions of said illumination means; and wherein said light reflective cover is partially translucent for emitting light through said reflective cover to the exterior.

2. The illuminated guard rail according to claim 1, wherein said means for surrounding said conventional guard rail comprise;

said light reflective cover comprising a first half and a second half wherein each of said first and second half are dimensioned and configured to cover said conventional guard rail when each of said first and second half are brought in mating relationship and therein secured together; and means for attaching said first and second half.

3. The illuminated guard rail according to claim 2, wherein said means for attaching said first and second half comprise snap fittings.

4. The illuminated guard rail according to claim 2, wherein said means for attaching said first and second half comprise screws.

5. The illuminated guard rail according to claim 2, wherein said means for attaching said first and second half comprise a collar.

6. The illuminated guard rail according to claim 1, wherein said means for surrounding said conventional guard rail comprise;

placing a reflective coating on the conventional guard rail, and extruding the said light reflective cover about said conventional guard rail and reflective coating together such that said light reflective cover covers said conventional guard rail and reflective coating.

7. The illuminated guard rail according to claim 6 wherein said reflective coating and said light reflective cover are made of acrylic.

8. The illuminated guard rail according to claim 7 wherein said illumination means for illuminating said light reflective cover comprise light emitting diodes.

9. The illuminated guard rail according to claim 8, wherein said light reflective cover has an inside and an outside, and a solvent containing Methyl Ethyl Keytone is sprayed on the light reflective cover to cause small cracks to form originating from the inside towards the outside of the light reflective cover.

10. The illuminated guard rail according to claim 1, wherein said means for surrounding said conventional guard rail comprise;

said light reflective cover comprising an inner covering and an outer covering, extruding the conventional guard rail with an inner covering and an outer covering such that said conventional guard rail is centrally located within said inner covering and said outer covering, said inner covering having an inside surface and an outside surface, said outer covering having an inner surface and an outer surface, said inner covering having a light reflective material on its inside surface, and said outside surface of said inner covering being adjacent to said inner surface of said outer covering.

11. An illuminated guard rail comprising:

a conventional rail, a light reflective cover dimensioned and configured to cover the conventional rail;

a fastener for securing said light reflective cover about the rail;

a light source for illuminating said light reflective cover;

said light reflective cover comprising a first half and a second half, each of said first and second half being dimensioned and configured to cover the rail when each of said first and second half are brought in mating relationship and therein secured together by said fastener.

12. The illuminated guard rail according to claim 11, wherein said fastener is mating snap fittings on said first and second half of said light reflective cover.

13. The illuminated guard rail according to claim 11, wherein said fastener is screws.

14. The illuminated guard rail according to claim 11, wherein said fastener is an end cap.

15. An illuminated guard rail comprising:

a conventional rail, a light reflective cover dimensioned and configured to cover the conventional rail;

a fastener for securing said light reflective cover about the rail;

a light source for illuminating said light reflective cover; placing a reflective coating on the conventional guard rail, and extruding the said light reflective cover about said conventional guard rail and reflective coating together such that said light reflective cover covers said conventional guard rail and reflective coating.

16. The illuminated guard rail according to claim 15 wherein said reflective coating and said light reflective cover are made of acrylic.

17. The illuminated guard rail according to claim 16 wherein said light source for illuminating said light reflective cover comprise light emitting diodes.

18. The illuminated guard rail according to claim 17, wherein said light reflective cover has an inside and an outside, and a solvent containing Methyl Ethyl Keytone is sprayed on the light reflective cover to cause small cracks to form originating from the inside towards the outside of the light reflective cover.

19. An illuminated guard rail comprising:

a conventional rail, a light reflective cover dimensioned and configured to cover the conventional rail;

a fastener for securing said light reflective cover about the rail;

a light source for illuminating said light reflective cover;

said light reflective cover comprises an inner covering and an outer covering, extruding the rail with an inner covering and an outer covering such that said rail is centrally located within said inner covering and said outer covering, said inner covering having an inside surface and an outside surface, said outer covering having an inner surface and an outer surface, said inner covering having a light reflective material on its inside surface, and said outside surface of said inner covering being adjacent to said inner surface of said outer covering.

* * * * *